US005669721A

United States Patent [19]

Santon et al.

[11] Patent Number: 5,669,721

[45] Date of Patent: Sep. 23, 1997

[54] METHOD AND APPARATUS FOR ACHIEVING INCREASED PRINTER THROUGHPUT

[75] Inventors: John C. Santon; Joseph Henry Bauman, both of Brush Prairie, Wash.

[73] Assignee: Hewlett-Packard Company, Palo Alto, Calif.

[21] Appl. No.: 648,470

[22] Filed: May 15, 1996

[51] Int. Cl.[6] ..... B41J 19/00

[52] U.S. Cl. ..... 400/279; 400/320.1; 400/582

[58] Field of Search ..... 400/279, 320, 400/322, 323, 341, 320.1, 582

[56] References Cited

U.S. PATENT DOCUMENTS

| | | | |
|---|---|---|---|
| 4,079,298 | 3/1978 | Prager . | |
| 4,324,499 | 4/1982 | Giacone . | |
| 4,332,461 | 6/1982 | Cail et al. . | |
| 4,529,281 | 7/1985 | DeRoche et al. . | |
| 4,541,334 | 9/1985 | Liedtke et al. . | |
| 4,761,085 | 8/1988 | Angst et al. . | |
| 4,772,837 | 9/1988 | MacMunn . | |
| 4,775,087 | 10/1988 | Moser et al. . | |
| 4,833,626 | 5/1989 | Malcolm . | |
| 4,869,610 | 9/1989 | Nishizawa et al. . | |
| 4,921,365 | 5/1990 | Sanders, Jr. et al. | 400/341 |
| 4,948,280 | 8/1990 | Sander, Jr. et al. | 400/341 |
| 5,189,436 | 2/1993 | Yoshikawa . | |
| 5,193,920 | 3/1993 | Matsumoto et al. | 400/322 |
| 5,527,121 | 6/1996 | Santon | 400/323 |

*Primary Examiner*—John S. Hilten

[57] ABSTRACT

A printer control method and apparatus are provided whereby print media feed and printhead carriage acceleration are overlapped in order to optimize the time which a printer spends preparing to print. The printhead carriage is accelerated at a time which has been determined to provide for concurrent completion of printhead carriage acceleration and media feed. This typically is accomplished by periodically previewing print data stored in memory for use in identifying a duration of time required to accelerate the printhead carriage to printing velocity and a duration of time required to advance the print medium. The difference between these times determines when to begin printhead carriage acceleration.

16 Claims, 1 Drawing Sheet

METHOD AND APPARATUS FOR ACHIEVING INCREASED PRINTER THROUGHPUT

TECHNICAL FIELD

The present invention relates generally to printers and, more particularly, to a method and apparatus whereby increased printer throughput may be achieved. More particularly still, the invention concerns a method of overlapping media feed and printhead acceleration in order to optimize the time which a printer spends preparing to print.

BACKGROUND ART

In a conventional printer, printing occurs via carriage-mounted printheads which are passed across print media at a maximum attainable carriage velocity, generally in an attempt to maximize printer throughput by minimizing actual printing time. Carriage velocity, however, is not without boundary, or without cost. As carriage velocity increases, for example, print quality may decrease due to inherent limitations of the printhead. Also, the maximum attainable carriage velocity is governed by the carriage motor's maximum acceleration rate, and by the distance available for the carriage to accelerate.

Printer manufacturers thus have struggled to increase printer throughput by improving printhead performance, and/or by increasing attainable carriage velocity through more powerful carriage motors or increased distance for the carriage to accelerate. This approach, however, has proven to be expensive, and has sometimes required an unnecessary compromise in printer size. Further, the cited approach has failed to recognize that printer throughput is related not only to the actual printing time, but also to the time spent accelerating and decelerating the carriage, and to the time spent advancing media both before and after printing a swath. It will be appreciated, for example, that conventional printers complete decelerating the carriage before advancing the media, and complete advancing the media before once again accelerating the carriage. What is needed is an approach which increases a printer's throughput by overlapping carriage deceleration, media advancement and carriage acceleration.

DISCLOSURE OF THE INVENTION

The aforementioned problems are addressed using a printer control method and apparatus whereby media feed and printhead carriage acceleration are overlapped in order to optimize the time which a printer spends preparing to print. According to the invented method, the printhead carriage is accelerated at a time which has been determined to provide for concurrent completion of printhead carriage acceleration and media feed. This typically is accomplished by periodically previewing print data stored in memory for use in identifying a duration of time required to accelerate the printhead carriage to printing velocity and a duration of time required to advance the print medium. The difference between these times determines when to begin printhead carriage acceleration.

The time to begin acceleration of the printhead carriage may be determined using a controller operatively connected to first and second motors, the first motor advancing the print media and the second motor accelerating the printhead carriage. Where the printer includes a feed mechanism which advances print media using a stepper motor, the time to begin acceleration of the printhead carriage may be characterized by a particular feed increment (or stepper motor step). The printhead carriage motor thus may be signalled to begin acceleration of the printhead carriage after a selected number of feed increments, which number is determined by taking the difference between the number of feed increments to advance the print medium and the number of feed increments to accelerate the printhead carriage to printing velocity.

The number of feed increments to accelerate the printhead carriage to printing velocity is identified by determining a difference between the number of feed increments to decelerate the feed mechanism, and the product of the feed rate and the difference between the duration of time to accelerate the printhead carriage to printing velocity and the duration of time to decelerate the feed mechanism. This determination typically is made prior to advancing the print medium, such advancement beginning immediately upon completing a print swath. Printhead carriage acceleration thereafter begins at the selected optimal time. Increased printer throughput thus is achieved by making the printer smarter without increasing the carriage motor's torque or the printer's footprint, all at the much lower cost of modifying controller firmware or code.

These and additional objects and advantages of the present invention will be more readily understood after a consideration of the drawings and the detailed description of the preferred embodiment.

DETAILED DESCRIPTION OF THE PREFERRED EMBODIMENT AND BEST MODE OF CARRYING OUT THE INVENTION

Figure 1:
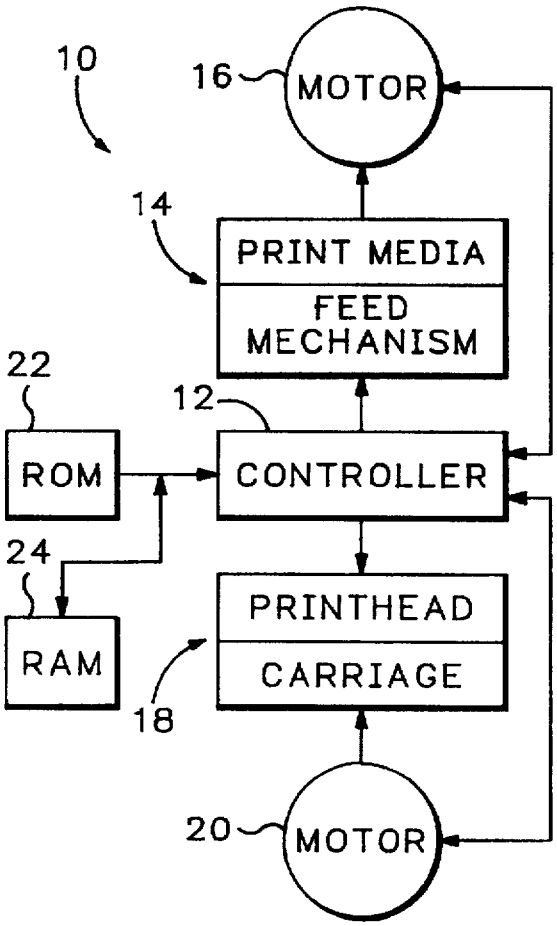
FIG. 1 is a schematic block diagram of an apparatus constructed in accordance with a preferred embodiment of the invention.

Referring initially to FIG. 1, a preferred embodiment of the invented printhead carriage control apparatus is shown in schematic block diagram form, such apparatus being indicated generally at 10. Apparatus 10, it will be noted, preferably includes a controller 12 (e.g., a microprocessor and associated control circuitry); a print media feed mechanism 14; a media feed motor 16; a printhead carriage 18; a carriage motor 20; a code or firmware parameter store (e.g., a read-only memory (ROM) device 22); and a print data buffer (e.g., a read-and-write memory (RAM) device 24). These components are implemented in a printer, preferably in the form of a somewhat typical bidirectional desktop printer such as an ink-jet printer of the type well known in the art.

As indicated, controller 12 is coupled with motors 16, 20, feed mechanism 14, printhead carriage 18, and the printer's memory (ROM 22 and RAM 24), the controller thus being made capable of previewing print data which is stored in RAM, and of executing instructions which are stored in ROM. The printer's feed motor 16, for example, may be directed to advance print media via feed mechanism 14. Similarly, carriage motor 20 may be directed to pass printhead carriage 18 across the print media, an onboard printhead depositing ink on the media so as to print a printable image from RAM. The velocity (speed and direction) of the printhead carriage also is controlled by the printer's controller, generally in view of the print data as it relates to predefined selection criteria stored in ROM.

Feed control signals (e.g., stepper pulses) are produced by the controller to command sheet media advancement, preferably immediately upon completing printing for a carriage pass. The feed motor 16 has a predetermined, relatively low torque and capacity, but is capable of directing the feed mechanism to accelerate, slew (move at constant velocity) and decelerate. The carriage motor 20 also has a predefined low torque and capacity, and is similarly capable of directing the printhead carriage to accelerate, slew and decelerate. Controller 12 thus produces carriage control signals (e.g., stepper pulses) which command carriage motor 20 controllably to slew the printhead carriage in either direction so as to move the carriage across the medium through reciprocating printhead carriage passes. The controller also produces printable data signals which represent pixel images to be deposited on the print medium by ink-jets within the printhead.

In accordance with the invention, controller 12 is capable of previewing the print data in RAM 24 in order to identify the number of feed motor steps (feed increments) employed to advance the print medium between predetermined carriage passes, and to identify the number of feed motor steps which occur during acceleration of the printhead carriage to printing velocity. This information then may be used in selecting an optimal time to begin carriage acceleration, preferably during advancement of the print media. These determinations typically are made prior to initiating the corresponding media advancement, and often are performed one or more carriage passes prior.

Previewing will be understood by those of skill in the art effectively to determine the number of feed motor steps which occur during acceleration of the printhead carriage to printing velocity, whether or not such a number is explicitly provided in the print data. In other words, it is within the spirit and scope of the invention for controller 12 simply to read a number of feed motor steps embedded in the data, or to calculate a number of feed motor steps in the manner described above.

In the preferred embodiment, the print data actually is previewed to identify: the number of feed motor steps employed to advance the print medium between carriage passes; the number of feed motor steps employed to decelerate the feed mechanism; the duration of time which it takes to accelerate the printhead carriage to printing velocity; the duration of time which it takes to decelerate the feed mechanism; and the feed rate of the feed mechanism. The number of feed motor steps which occur during acceleration of the printhead carriage to printing velocity then is determined using the identified information.

The number of feed motor steps which occur during acceleration of the printhead carriage to printing velocity thus typically may be identified by determining a sum of the number of feed motor steps to decelerate the feed mechanism, and the product of the feed rate and the difference between the duration of time to accelerate the printhead carriage to printing velocity and the duration of time to decelerate the feed mechanism. Stated alternatively, the number of feed motor steps which occur during acceleration of the printhead carriage may be determined in accordance with the expression:

$$DFM_i+FR(APC_r-DFM_r)$$

where $DFM_i$ is the number of feed motor steps to decelerate the feed mechanism, FR is the feed rate, $APC_r$ is the duration of time to accelerate the printhead carriage to printing velocity, and $DFM_r$ is the duration of time to decelerate the feed mechanism.

Once the number of feed motor steps employed to advance the print medium between carriage passes has been identified and the number of feed motor steps which occur during acceleration of the printhead carriage to printing velocity has been identified, it is possible to select an optimal time to begin accelerating the printhead carriage. Such optimal time is defined by determining a difference between the duration of time required to advance the print medium and the duration of time required to accelerate the printhead carriage to printing velocity. The printhead carriage thus optimally being acceleration at a time which provides for concurrent completion of print media advancement and carriage acceleration. It is possible, however, that carriage acceleration will occur after completing print media advancement where, for example, the time required to decelerate and immediately accelerate the printhead carriage is greater than the time required to advance the print medium. In such a situation, printhead carriage acceleration beings immediately upon completing printhead carriage deceleration.

The optimal time to begin acceleration of the printhead carriage alternatively is defined by determining the difference between the number of feed motor steps which it takes to advance the print medium and the number of feed motor steps which occur during acceleration of the printhead carriage to printing velocity. This difference identifies a time to begin acceleration of the printhead carriage which is defined in terms of a number of feed motor steps after initiating media advance.

The number of feed motor steps which pass before beginning printhead carriage acceleration, however, typically will be required to be at least as many feed motor steps as are used to accelerate the feed mechanism to a desired feed rate. This avoids accelerating both the carriage motor and feed motor simultaneously, a situation which might be undesirable due to increased power draw. The optimal number of feed motor steps which pass prior to beginning acceleration of the printhead carriage thus is typically selected to be the maximum of: 1) the determined difference between the number of feed motor steps which it takes to advance the print medium and the number of feed motor steps which occur during acceleration of the printhead carriage to printing velocity; and 2) the number of feed motor steps which are used to accelerate the feed mechanism to a desired feed rate.

Accordingly, a counter may be employed whereby steps of the feed motor may be tracked to determine when to begin accelerating the printhead carriage. Upon reaching a predetermined feed motor step, a signal may be given, directing initiation of printhead carriage acceleration.

It will be understood that the optimal time to begin printhead carriage acceleration may vary, between carriage passes due to factors such as printing velocity, media advancement distance, or the like. For example, in one embodiment of the invention, swath length is used in selecting an optimal velocity characteristic for each corresponding printhead carriage pass. Such selection is made by the controller using predetermined selection criteria which are stored in ROM 22. Media advancement distances similarly may vary due to differing line spacings or the like.

A print operation begins by advancing print media to a printing position and accelerating the printhead carriage, preferably in overlapping actions directed by controller 12. Each print operation includes one or more carriage passes, and one or more media advancements which typically occur between (and overlapping with) carriage passes. The controller begins a carriage pass by producing carriage control signals which cause the printhead carriage to accelerate to an optimal printing velocity in accordance with a selected acceleration profile. The controller next causes the carriage to slew across the sheet at the optimal printing velocity, and directs the printhead to print a printable image. Upon completing the swath (i.e., reaching a last print location), the controller produces carriage control signals which cause the carriage to decelerate to a stop in accordance with a selected deceleration profile, thus ending the carriage pass.

Prior to each carriage pass, and preferably prior to each corresponding media advancement, the controller previews print data to identify criteria useful in selecting the optimal time to begin printhead carriage acceleration. Selection also preferably occurs prior to each carriage pass, and to each corresponding media advancement. In fact, in the preferred embodiment, preview and selection preferably occur during deceleration of an earlier carriage pass. Therefore, any processing delay is masked by the carriage deceleration time.

Apparatus 10 is compatible with bi-directional printing, providing a context whereby another advantage of the invention may be understood. As previously indicated, toward the end of a given carriage pass, controller 12 will have already previewed the print data within RAM 24. Persons skilled in the art will appreciate that such determination requires only negligible time relative to the time required to decelerate the carriage from a suitably high printing velocity. Controller 12 thus will have already selected the time to begin printhead carriage acceleration, the acceleration profile, the printing velocity, and the deceleration profile of the printhead carriage for the next carriage pass when the carriage reaches the end of the current pass.

Figure 2:
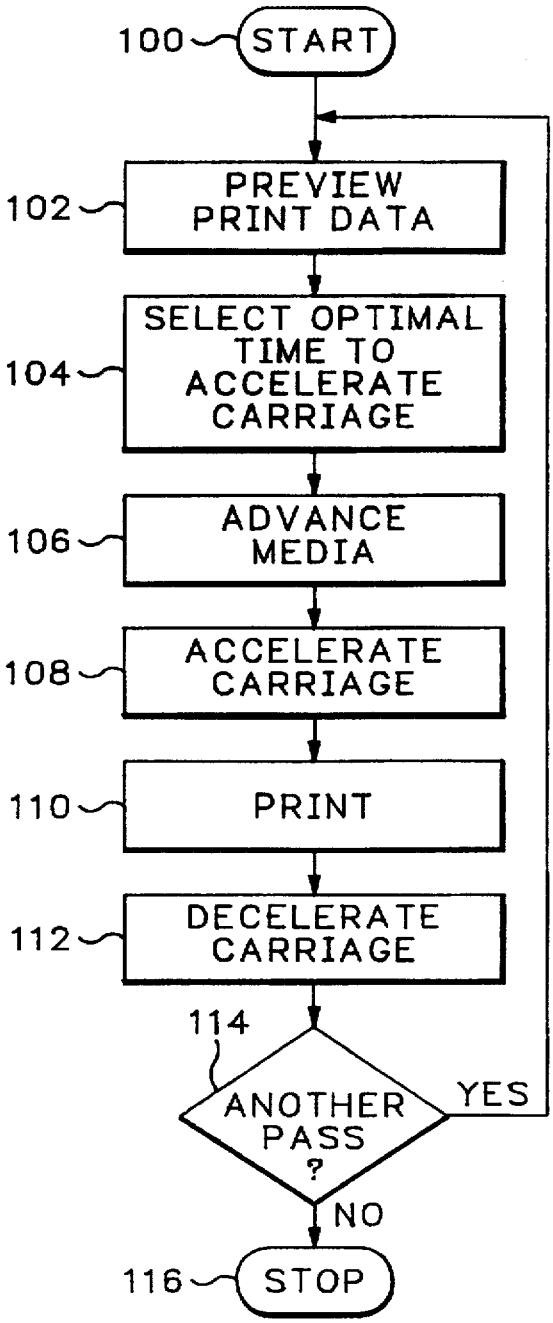
FIG. 2 is a flowchart illustrating the preferred method of the invention.

Turning now to FIG. 2, the preferred method of the invention is described by a flowchart, such flowchart disclosing a print operation which being at 100, and which includes the steps of: previewing the print data to identify criteria useful in selecting the optimal time to begin printhead carriage acceleration, as indicated generally at 102; selecting an optimal time to begin acceleration of the printhead carriage based on the identified criteria, as indicated generally at 104; advancing the print media, as indicated generally at 106; accelerating the printhead carriage beginning a time corresponding to the optimal time to begin acceleration of the printhead carriage, as indicated generally at 108; printing a printable image (at an optimal carriage velocity), as indicated generally at 110; and decelerating the carriage to a stop, as indicated generally at 112. At 114, it is determined whether another pass is desired, and if so, the preceding steps (102 through 112) are repeated. If no other pass is desired, processing stops, as indicated generally at 116. Previewing the print data may include determining a last print location, the corresponding print media advancement beginning with the printhead carriage substantially thereat.

The invented method thus may be seen to represent a significant improvement over known methods of controlling print media throughput in a printer having data stored in its memory. Such methods are characterized as including the steps of accelerating the printhead carriage only after the print media has been advanced, printing the printable image, and then decelerating the carriage before beginning the next print media advance. The improvement may be understood to include beginning acceleration of the printhead carriage during corresponding print media advancement in order to provide for concurrent completion of the print media advancement and printhead carriage acceleration. Preferably, previewing, selecting, accelerating, printing and decelerating steps are repeated for each successive pass of the printhead carriage. The optimal time (i.e., the number of feed motor steps after beginning print media advance) to begin printhead carriage acceleration thus will vary in accordance with the criteria determined with each preview of print data, as indicated by the directed flow control paths between the "another pass?" decision block 114 and the "preview print data" decision block 102 (FIG. 2).

As previously indicated, printhead throughput is determined by the time spent reciprocating the printhead carriage through consecutive carriage passes, each such pass adding to the time required to complete printing of the present sheet. Printer throughput thus is related, not only to the actual printing time, but also to the carriage's acceleration and deceleration times. The total duration of a print operation therefore may be considered to be the sum of the time required for advancing print media, printhead carriage acceleration, printing, and printhead carriage deceleration.

Industrial Applicability

It may be seen than that the invented method and apparatus greatly increase carriage printer throughput, with negligible incremental cost, by intelligently varying the time at which printhead acceleration begins based on criteria such as printhead carriage velocity and the distance which print media is advanced. The printer's controller need only preview successive print data and utilize the information contained within such data to determine the optimal time to begin printhead acceleration for a particular carriage pass. The invented method and apparatus are compatible with present printer technologies, including carriage motor torque and acceleration constraints and printer housing configuration (e.g., footprint, constraints). Such method, in fact, may be imported into existing printer installations by adding code or firmware to an existing printer controller's microcode.

While the present invention has been shown and described with reference to the foregoing operational principles and preferred embodiment, it will be apparent to those skilled in the art that other changes in form and detail may be made therein without departing from the spirit and scope of the invention as defined in the appended claims.

We claim:

1. An improved printer control method which includes repeated steps of accelerating a printhead carriage to a printing velocity, printing a printable image on print media, decelerating the printhead carriage, and advancing the print media, the improvement comprising:

selecting an optimal time to begin accelerating the printhead carriage, such selecting including determining a difference between a duration of time to accelerate the printhead carriage to printing velocity and a duration of time required to advance the print medium, such difference defining a time at which to begin an accelerating step in order to provide for concurrent completion of carriage acceleration and media advancement; and beginning the accelerating step during a corresponding advancing step at a time which provides for concurrent completion of carriage acceleration and media advancement.

2. The improvement of claim 1 which further comprises a step of previewing print data stored in memory for use in identifying the duration of time required to accelerate the printhead carriage to printing velocity and in identifying the duration of time required to advance the print medium.

3. The improvement of claim 2 which further comprises repeating the previewing, selecting, advancing, accelerating, printing and decelerating steps for successive passes of the printhead carriage, said previewing and selecting steps being completed prior to beginning said advancing step.

4. The improvement of claim 3, wherein each previewing step at least partly overlaps a corresponding earlier accelerating step.

5. The improvement of claim 3, wherein said accelerating, printing and decelerating steps of successive passes are performed bi-directionally.

6. A printer for use in printing on print media in successive print swaths, the printer comprising:

a first motor;

a feed mechanism which advances print media using said first motor;

a second motor;

a printhead carriage which is movable via said second motor; and a controller operatively connected to said first and second motors to control operation of said motors, said controller identifying a duration of time which will be required to accelerate said printhead carriage to printing velocity to print a subsequent print swath, identifying a duration of time which will be required to advance the print medium prior to such subsequent print swath, and determining a time at which to begin accelerating said printhead carriage in order to provide for concurrent completion of carriage acceleration and media advancement;

said controller causing the first motor to begin advancing print media at a first time, and causing the second motor to begin acceleration of the printhead carriage at a second time determined to provide for concurrent completion of carriage acceleration and media advancement.

7. The improvement of claim 6 which further comprises printer memory including predetermined acceleration durations corresponding to various print swath lengths, said controller determining the time at which to begin accelerating the printhead carriage based on an acceleration duration stored in the printer memory and corresponding to a length of the subsequent print swath.

8. The improvement of claim 6, wherein the first motor begins advancing print media at a time corresponding to completion of a print swath.

9. A printer control method for use in a printer which includes a printhead mounted on a printhead carriage for movement across a print medium in successive carriage passes, the print medium being incrementally advanced between carriage passes via a feed mechanism, the method comprising the steps of:

previewing the print data stored in memory to identify a number of feed increments required to accelerate the feed mechanism to a predetermined feed rate a number of feed increments to advance the print medium between carriage passes and a number of feed increments to accelerate the printhead carriage to printing velocity the optimal time to begin acceleration of the printhead carriage being a maximum of: a) the number of feed increments required to accelerate the feed mechanism to a predetermined feed rate; and b) the difference between the identified number of feed increments to advance the print medium and the identified number of feed increments to accelerate the printhead carriage to printing velocity;

selecting an optimal time to begin acceleration of the printhead carriage by determining a difference between the identified number of feed increments to advance the print medium and the identified number of feed increments to accelerate the printhead carriage to printing velocity;

advancing the print medium;

accelerating the printhead carriage beginning at the selected optimal time to begin acceleration of the printhead carriage;

printing on the print medium; and decelerating the printhead carriage.

10. The method of claim 9, wherein said previewing step includes identifying a number of feed increments to decelerate the feed mechanism, a duration of time to accelerate the printhead carriage to printing velocity, a duration of time to decelerate the feed mechanism, and a feed rate of the feed mechanism, the number of feed increments to accelerate the printhead carriage to printing velocity being identified by determining a sum of the number of feed increments to decelerate the feed mechanism and the product of the feed rate and the difference between the duration of time to accelerate the printhead carriage to printing velocity and the duration of time to decelerate the feed mechanism.

11. The method of claim 9 which further comprises repeating the previewing, selecting, advancing, accelerating, printing and decelerating steps for successive passes of the printhead carriage, said previewing and selecting steps being completed prior to beginning said advancing step.

12. The method of claim 11, wherein each previewing step at least partly overlaps a corresponding earlier accelerating step.

13. The method of claim 11, wherein each successive advancing step at least partly overlaps a corresponding earlier decelerating step.

14. The method of claim 11, wherein said accelerating, printing and decelerating steps of successive passes are performed bi-directionally.

15. The method of claim 9, wherein each previewing step includes determining a last print location, the corresponding advancing step beginning with the printhead carriage substantially thereat.

16. The method of claim 9, wherein the number of feed increments to accelerate the printhead carriage to printing velocity is determined in accordance with the expression:

$$DFM_i + FR(APC_t - DFM_t)$$

where $DFM_i$ is the number of feed increments to decelerate the feed mechanism, FR is the feed rate, $APC_t$ is the duration of time to accelerate the printhead carriage to printing velocity, and $DFM_t$ is the duration of time to decelerate the feed mechanism.

* * * * *